US008444133B2

(12) United States Patent
Kimura

(10) Patent No.: US 8,444,133 B2
(45) Date of Patent: May 21, 2013

(54) SHEET PROCESSING APPARATUS, IMAGE FORMING SYSTEM, AND SHEET PROCESSING METHOD

(75) Inventor: Masatoshi Kimura, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/035,224

(22) Filed: Feb. 25, 2011

(65) Prior Publication Data

US 2011/0304090 A1 Dec. 15, 2011

(30) Foreign Application Priority Data

Jun. 9, 2010 (JP) ..... 2010-131828

(51) Int. Cl.
*B65H 37/04* (2006.01)

(52) U.S. Cl.
USPC ..... 270/58.08; 270/58.07; 270/58.09; 270/58.11; 270/58.12

(58) Field of Classification Search
USPC ..... 270/58.07, 58.08, 58.09, 58.11, 58.12
See application file for complete search history.

(56) References Cited

U.S. PATENT DOCUMENTS

| | | | | |
|---|---|---|---|---|
| 3,577,575 | A * | 5/1971 | Taniguchi | 7/158 |
| 5,717,843 | A * | 2/1998 | Tabata et al. | 358/1.18 |
| 5,899,841 | A | 5/1999 | Berger | |
| 6,354,059 | B1 * | 3/2002 | Yoshie et al. | 53/117 |
| 7,198,268 | B2 * | 4/2007 | Yamada et al. | 271/303 |
| 2007/0278732 | A1 * | 12/2007 | Kitahara | 270/58.08 |

FOREIGN PATENT DOCUMENTS

| | | |
|---|---|---|
| JP | 3885410 B2 | 12/2006 |
| JP | 4044416 B2 | 11/2007 |

* cited by examiner

*Primary Examiner* — Leslie A Nicholson, III
(74) *Attorney, Agent, or Firm* — Sughrue Mion, PLLC

(57) ABSTRACT

A sheet processing apparatus includes a support unit on which sheets are stacked together as a sheet stack, first and second binding units that respectively perform first and second binding processes to bind the sheet stack as first and second sheet stacks, a transporting unit that transports the first and second sheet stacks toward first and second paths, respectively, which are in opposite directions, a reversing-and-transporting unit disposed at the second path to transport the second sheet stack such that upper and lower sides thereof are reversed, a first transported-sheet-stack support unit that is disposed at the first path and on which the first sheet stack transported by the transporting unit is placed, and a second transported-sheet-stack support unit that is disposed at the second path and on which the second sheet stack reversed and transported by the reversing-and-transporting unit is placed.

12 Claims, 8 Drawing Sheets

SHEET PROCESSING APPARATUS, IMAGE FORMING SYSTEM, AND SHEET PROCESSING METHOD

CROSS-REFERENCE TO RELATED APPLICATIONS

This application is based on and claims priority under 35 USC 119 from Japanese Patent Application No. 2010-131828 filed Jun. 9, 2010.

BACKGROUND

The present invention relates to a sheet processing apparatus, an image forming system, and a sheet processing method.

SUMMARY

According to an aspect of the invention, a sheet processing apparatus includes a support unit on which sheets are stacked together as a sheet stack in which the sheets are aligned; a first binding unit that performs a first binding process to bind the sheet stack placed on the support unit as a first sheet stack; a second binding unit that performs a second binding process to bind the sheet stack placed on the support unit as a second sheet stack; a transporting unit that transports the first sheet stack from the support unit toward a first path and transports the second sheet stack from the support unit toward a second path in a direction opposite to the first path; a reversing-and-transporting unit arranged at the second path, the reversing-and-transporting unit transporting the second sheet stack such that upper and lower sides of the second sheet stack are reversed; a first transported-sheet-stack support unit arranged at the first path, the first sheet stack transported by the transporting unit being placed on the first transported-sheet-stack support unit; and a second transported-sheet-stack support unit arranged at the second path, the second sheet stack reversed and transported by the reversing-and-transporting unit being placed on the second transported-sheet-stack support unit.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described in detail with reference to the accompanying drawings.

According to the exemplary embodiments, in a sheet processing apparatus capable of binding sheet stacks by plural binding processes, two types of structures may be adopted as structures for reducing a risk that bound portions of the sheet stacks will be damaged when the sheet stacks are transported. The two types of structures are a structure in which a transporting path of each sheet stack is switched in accordance with the binding process to which the sheet stack has been subjected and a structure in which the sheet stacks are ejected such that the bound portions of the sheet stacks are displaced from each other.

Image Forming System 1

Figure 1:
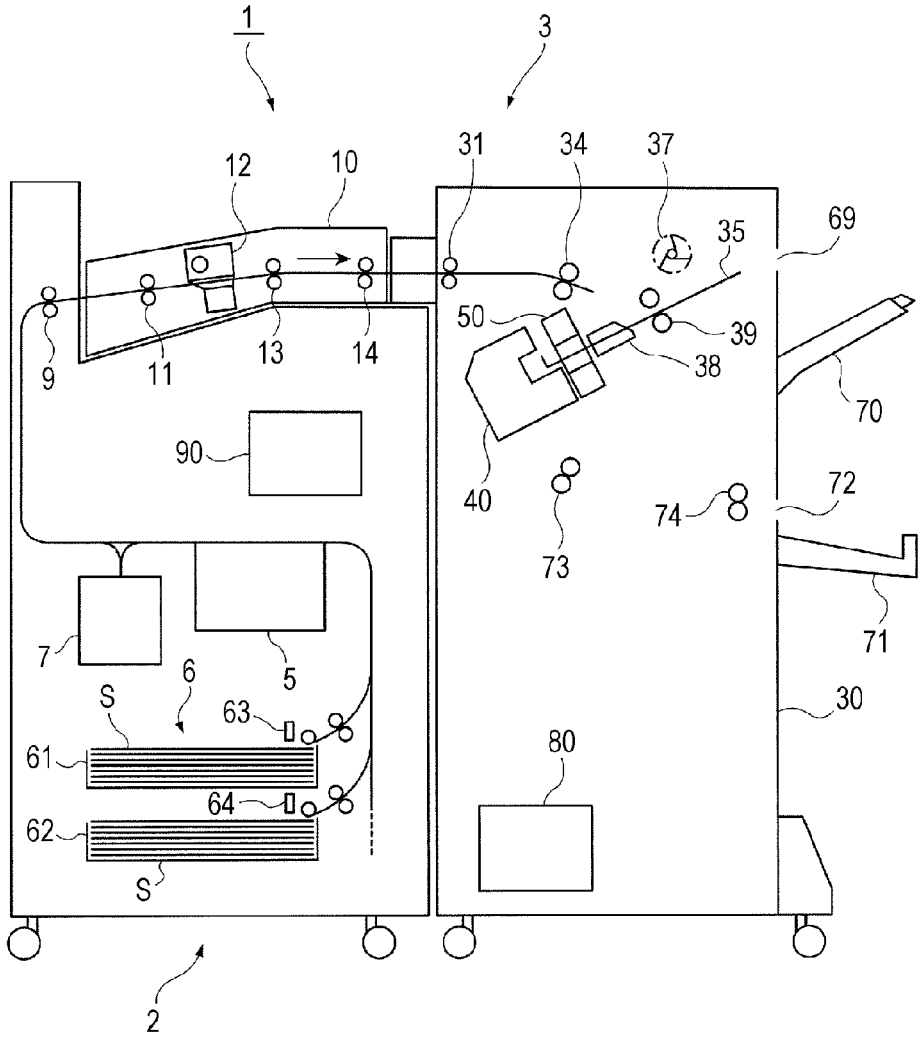
FIG. 1 is a schematic diagram of an image forming system related to an exemplary embodiment of the present invention.

FIG. 1 is a schematic diagram illustrating an image forming system 1 of the present exemplary embodiment. The image forming system 1 illustrated in FIG. 1 includes an image forming apparatus 2 and a sheet processing apparatus 3. The image forming apparatus 2 is, for example, a printer or a copy machine which forms an image by an electrophotographic system. The sheet processing apparatus 3 performs post-processing for a sheet S of paper on which a toner image, for example, is formed by the image forming apparatus 2.

The image forming apparatus 2 includes a sheet supply unit 6 that supplies a sheet S on which an image is to be formed and an image forming unit 5 which forms the image on the sheet S supplied by the sheet supplying unit 6. The image forming apparatus 2 also includes a sheet reversing device 7 which reverses the sheet S on which the image have been formed by the image forming unit 5 and eject rollers 9 which eject the sheet S on which the image has been formed. The image forming apparatus 2 also includes a user interface 90 which receives information regarding a binding process from a user.

The sheet supplying unit 6 includes a first sheet storing unit 61 and a second sheet storing unit 62 on which sheets S are stacked and which supply the sheets S to the image forming unit 5. The sheet supplying unit 6 also includes a first sheet detecting sensor 63 that detects the presence or absence of the sheets S on the first sheet storing unit 61 and a second sheet detecting sensor 64 that detects the presence or absence of the sheets S on the second sheet storing unit 62.

The sheet processing apparatus 3 includes a transporting device 10 and a post-processing device 30. The transporting device 10 receives the sheets S output from the image forming apparatus 2 and transports the sheets S further downstream. The post-processing device 30 includes a compiling support unit 35 on which the sheets S are collected and stacked and a stapler 40 which binds edge portions of the sheets S together. The sheet processing apparatus 3 also includes a controller 80 that controls the overall operation of the image forming system 1.

The transporting device 10 included in the sheet processing apparatus 3 includes inlet rollers 11, which are a pair of rollers that receive the sheets S output from the image forming apparatus 2 through the eject rollers 9 and a puncher 12 that punches holes in the sheets S received by the inlet rollers 11 as necessary. The transporting device 10 also includes first transporting rollers 13 and second transporting rollers 14 that are arranged downstream of the puncher 12. The first transporting rollers 13 are a pair of rollers that transport the sheets S further downstream, and the second transporting rollers 14 are a pair of rollers that transport the sheets S toward the post-processing device 30.

The post-processing device 30 included in the sheet processing apparatus 3 includes receiving rollers 31, which are a pair of rollers that receive the sheets S from the transporting device 10. The post-processing device 30 also includes the compiling support unit 35 and exit rollers 34. The compiling support unit 35 is arranged downstream of the receiving rollers 31, and multiple sheets S are collected and stacked on the compiling support unit 35. The exit rollers 34 are a pair of rollers that eject each sheet S toward the compiling support unit 35.

The post-processing device 30 also includes a paddle unit 37 which rotates so as to push each sheet S toward an end guide 35*b* (described below) of the compiling support unit 35. The post-processing device 30 also includes a side guide unit 38 that aligns edge portions of each sheet S. The post-processing device 30 also includes eject rollers 39 which press the sheets S stacked on the compiling support unit 35 and transport the stack of sheets S in a bound state toward the downstream side by rotating in forward and reverse directions. The post-processing device 30 also includes reversing-and-transporting rollers 73 and reversing eject rollers 74. The reversing-and-transporting rollers 73 transport the stack of sheets S transported from the eject rollers 39 in a direction different from the direction in which the stack of sheets S has been transported by the eject rollers 39. The reversing eject rollers 74 receive the stack of sheets S that has been transported by the reversing-and-transporting rollers 73 and transport the stack of sheets S so as to eject the stack of sheets S.

The post-processing device 30 also includes the stapler 40 and a staple-free binding device 50. The stapler 40 binds edge portions of the sheets S stacked on the compiling support unit 35 together using a staple 41 (described below). The staple-free binding device 50 binds edge portions of the sheets S together without using the staple 41.

The post-processing device 30 also includes a first opening 69 and a first output tray 70. The stack of sheets S may be ejected to the outside of the post-processing device 30 by the eject rollers 39 through the first opening 69. Multiple stacks of sheets S ejected through the first opening 69 may be stacked on the first output tray 70 such that the user may easily take the stacks of sheets S. The post-processing device 30 also includes a second opening 72 which is positioned below the first opening 69 and a second output tray 71 which is positioned below the first output tray 70. The stack of sheets S may be ejected to the outside of the post-processing device 30 by the reversing eject rollers 74 through the second opening 72. Multiple stacks of sheets S ejected through the second opening 72 may be stacked on the second output tray 71 such that the user may easily take the stacks of sheets S.

Figure 2:
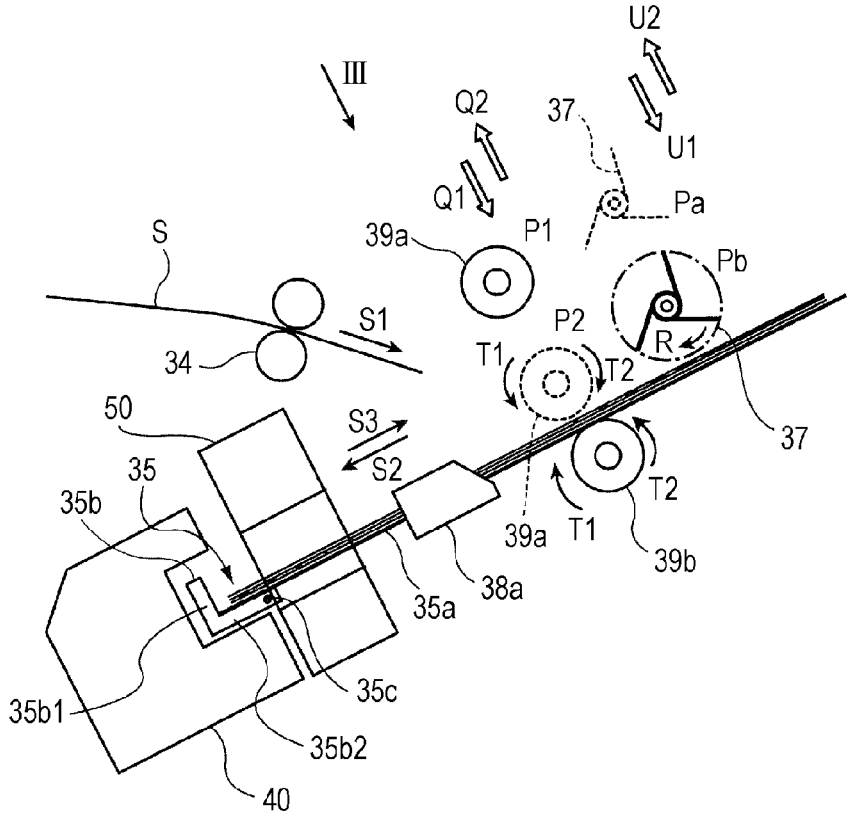
FIG. 2 is a schematic diagram illustrating an area around a compiling support unit.
Figure 3:
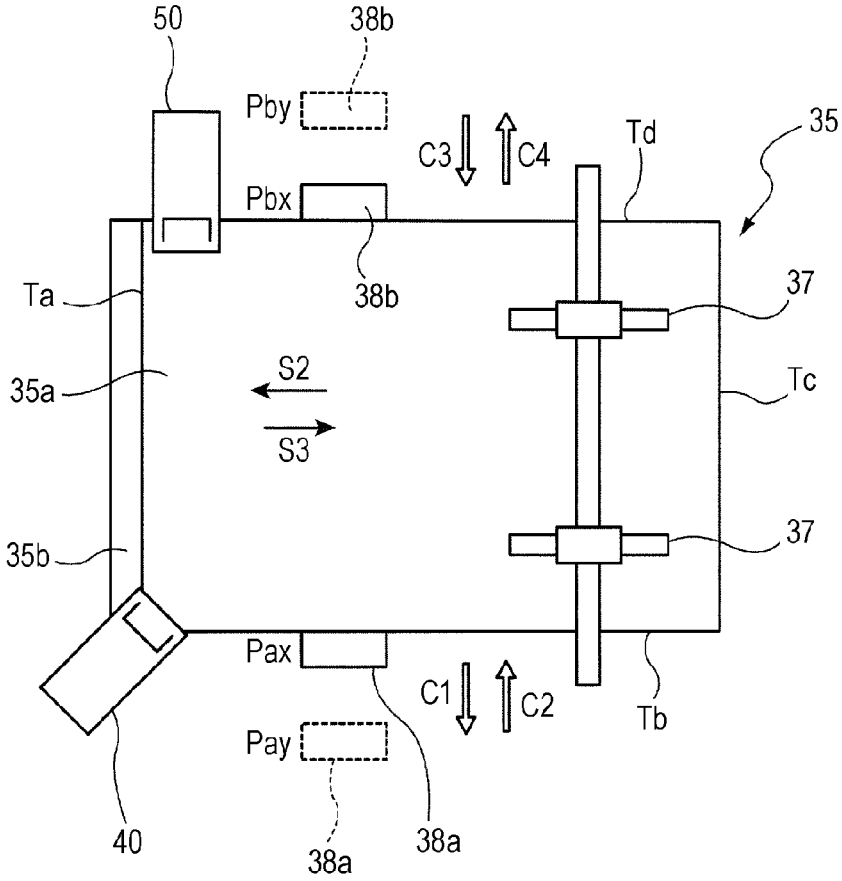
FIG. 3 is a schematic diagram illustrating the area around the compiling support unit viewed in a direction shown by arrow III in FIG. 2.

Next, the compiling support unit 35 and devices, such as the stapler 40 and the staple-free binding device 50, arranged around the compiling support unit 35 will be described with reference to FIGS. 2 and 3. FIG. 2 is a schematic diagram illustrating an area around the compiling support unit 35, and FIG. 3 is a schematic diagram illustrating the area around the compiling support unit 35 viewed in a direction shown by arrow III in FIG. 2. In FIG. 3, the lower side is a front side in FIGS. 1 and 2. For simplicity, some components, such as the eject rollers 39, are not illustrated in FIG. 3.

The compiling support unit 35, which is an example of a support unit, includes a bottom portion 35*a* that has an upper surface on which the sheets S are stacked and the end guide 35*b* arranged near the bottom portion 35*a*.

As described in detail below, in the area around the compiling support unit 35, each sheet S is transported toward the compiling support unit 35 (in a first moving direction S1 in FIG. 2), and then the moving direction of the sheet S is changed such that the sheet S slides downward along the bottom portion 35*a* of the compiling support unit 35 (in a second moving direction S2 in FIG. 2). Then, an edge portion of each sheet S is aligned, and a stack of sheets S is prepared. The stack of sheets S may move further downward along the bottom portion 35*a* of the compiling support unit 35. Alternatively, the moving direction may be reversed such that the stack of sheets S moves upward along the bottom portion 35*a* of the compiling support unit 35 (in a third moving direction S3 in FIG. 2).

The end guide 35*b*, which is an example of an edge aligner, aligns an edge portion of each sheet S that slides downward along the bottom portion 35*a* at a front end of the sheet S in the moving direction thereof. The end guide 35*b* includes an aligning portion 35*b*1 that aligns the edge portion of each sheet S, an arm portion 35*b*2 that is connected to the aligning portion 35*b*1 at one edge thereof, and a rotation shaft 35*c* provided at the other edge of the arm portion 35*b*2. The rotation shaft 35*c* serves as a rotation center when the aligning portion 35*b*1 and the arm portion 35*b*2 rotate. Thus, the end guide 35*b* is provided such that the end guide 35*b* is rotatable around the rotation shaft 35*c*. The rotation shaft 35*c* is provided at a lower section of the bottom portion 35*a* so as to extend substantially parallel to the edge portion of each sheet S at the front end thereof in the moving direction. In this specification, the meanings of "substantially parallel", "substantially perpendicular", and "substantially rectangular" includes parallel, perpendicular, and rectangular, respectively.

When the end guide 35*b* aligns the edge portion of each sheet S that slides downward along the bottom portion 35*a* at the front end of the sheet S in the moving direction thereof, the end guide 35*b* is arranged so as to prevent the sheet S that slides along the upper surface of the bottom portion 35*a* from falling, as illustrated in FIG. 2. More specifically, the end guide 35*b* is arranged such that the aligning portion 35*b*1 includes a surface that is substantially perpendicular to the bottom portion 35*a* at the front end of the bottom portion 35*a* in the moving direction of each sheet S that slides downward along the upper surface of the bottom portion 35*a* (the downstream end in the second moving direction S2 in FIG. 2).

When the stack of sheets S is ejected along a second ejection transporting path (described below), the end guide 35*b* is arranged so as not to prevent the stack of sheets from moving downward along the upper surface of the bottom portion 35*a*. More specifically, the end guide 35*b* rotates around the rotation shaft 35*c* so that the aligning portion 35*b*1 does not block the second ejection transporting path, and such that the aligning portion 35*b*1 is below the rotation shaft 35*c* in the present exemplary embodiment.

The paddle unit 37 is positioned above the compiling support unit 35 and downstream of the exit rollers 34 in the first moving direction S1 of each sheet S. The paddle unit 37 is driven by a motor or the like (not shown) such that a distance between the paddle unit 37 and the bottom portion 35*a* of the compiling support unit 35 changes. More specifically, the paddle unit 37 is movable in directions shown by arrows U1 and U2 in FIG. 2. The paddle unit 37 moves in the direction shown by arrow U1 to a position near the bottom portion 35*a* of the compiling support unit 35 (position Pb at which the paddle unit 37 is drawn by solid lines), and moves in the direction shown by arrow U2 to a position separated from the bottom portion 35*a* of the compiling support unit 35 (position Pa at which the paddle unit 37 is drawn by dashed lines). The paddle unit 37 is configured to push each sheet S along the compiling support unit 35 in the second moving direction S2 in FIG. 2 by rotating in a direction shown by arrow R in FIG. 2 after the sheet S is transported along the first moving direction S1.

The side guide unit 38 includes a first side guide 38*a* and a second side guide 38*b* that are opposed to each other with the compiling support unit 35 arranged therebetween. More specifically, the first side guide 38*a* and the second side guide 38*b* are opposed to each other in a direction that crosses the second moving direction S2 (vertical direction in FIG. 3). In FIG. 3, the first side guide 38*a* is arranged at the lower side of the compiling support unit 35 and the second side guide 38*b* is arranged at the upper side of the compiling support unit 35. The first side guide 38*a* and the second side guide 38*b* are driven by a motor or the like (not shown) such that a distance between the first side guide 38*a* and the second side guide 38*b* changes.

The side guide unit 38 is configured to align edge portions of each sheet S that extend along the direction in which the sheet S slides downward along the bottom portion 35*a*. More specifically, the first side guide 38*a* is arranged to be movable (in directions shown by arrows C1 and C2) between a position near the compiling support unit 35 (position Pax at which the first side guide 38*a* is drawn by solid lines) and a position separated from the compiling support unit 35 (position Pay at which the first side guide 38*a* is drawn by dashed lines). The second side guide 38*b* is arranged to be movable (in directions shown by arrows C3 and C4) between a position near the compiling support unit 35 (position Pbx at which the second side guide 38*b* is drawn by solid lines) and a position separated from the compiling support unit 35 (position Pby at which the second side guide 38*b* is drawn by dashed lines).

In the present exemplary embodiment, the positions Pax, Pay, Pbx, and Pby of the first and second side guides 38*a* and 38*b* may be changed in accordance with the size and direction of the sheets S supplied to the compiling support unit 35.

The eject rollers 39 serve as an example of a transporting unit, and include a first eject roller 39*a* and a second eject roller 39*b*. The first eject roller 39*a* and the second eject roller 39*b* are respectively arranged above and below the bottom portion 35*a* of the compiling support unit 35 so as to be opposed to each other with the bottom portion 35*a* positioned therebetween.

The first eject roller 39*a* is provided adjacent to the bottom portion 35*a* of the compiling support unit 35 at a side at which the sheets S are stacked. The first eject roller 39*a* is driven by a motor or the like (not shown) such that the first eject roller 39*a* moves toward or away from the second eject roller 39*b*. In other words, a distance between the first eject roller 39*a* and the stack of sheets S placed on the bottom portion 35*a* of the compiling support unit 35 is changeable. The second eject roller 39*b* is arranged adjacent to the bottom portion 35*a* of the compiling support unit 35 at a side opposite to the side at which the sheets S are stacked. The position of the second eject roller 39*b* is fixed, and the second eject roller 39*b* only rotates.

The first eject roller 39*a* moves in a direction shown by arrow Q1 to a position where the first eject roller 39*a* is near the bottom portion 35*a* of the compiling support unit 35 (position P2 at which the first eject roller 39*a* is drawn by dashed lines). The first eject roller 39*a* moves in a direction shown by arrow Q2 to a position where the first eject roller 39*a* is moved away from the bottom portion 35*a* of the compiling support unit 35 (position P1 at which the first eject roller 39*a* is drawn by solid lines).

The first eject roller 39*a* is driven by a motor or the like (not shown) so as to rotate while the first eject roller 39*a* is in contact with the stack of sheets S. The first eject roller 39*a* rotates in a direction shown by arrow T1 to transport the stack of sheets S upward (in the third moving direction S3) or in a direction shown by arrow T2 opposite to the direction shown by arrow T1 to transport the stack of sheets S downward (in the second moving direction S2).

The positions P1 and P2 of the first eject roller 39*a* may be changed in accordance with the number of sheets S supplied to the compiling support unit 35 and the thickness of the sheets S.

Further explanation will be given with reference to FIG. 1.

The first opening 69 is positioned downstream of the first eject roller 39*a* in the third moving direction S3. The stack of sheets S subjected to the binding process may be transported through the first opening 69.

The first output tray 70, which is an example of a first transported-sheet-stack support unit, includes a surface on which multiple stacks of sheets S that have been ejected through the first opening 69 may be stacked. The surface of the first output tray 70 on which the stacks of sheets S are stacked is inclined. More specifically, the surface is inclined such that an end of the surface that is far from the first opening 69 is positioned above the other end that is adjacent to the first opening 69.

The reversing-and-transporting rollers 73, which are an example of a reversing-and-transporting unit, are a pair of rollers that are positioned downstream of the first eject roller 39*a* in the second moving direction S2. The reversing-and-transporting rollers 73 are arranged so as to transport the stack of sheets S along the second ejection transporting path (described below), which is a path that reverses the stack of sheets S upside down while transporting the stack of sheets S. The reversing-and-transporting rollers 73 transport the stack of sheets S along a path similar to a U-turn path.

The reversing-and-transporting rollers 73 are opposed to each other with the second ejection transporting path positioned therebetween. The reversing-and-transporting rollers 73 are arranged such that the orientation of the stack of sheets S transported toward the reversing-and-transporting rollers 73 differs from the orientation of the stack of sheets S transported further downward from the reversing-and-transporting rollers 73.

Although the reversing-and-transporting rollers 73 are explained as a single pair of rollers for simplicity, multiple pairs of rollers may be provided as the reversing-and-transporting rollers 73. In such a case, the pairs of rollers are arranged along the second ejection transporting path (described below) and are arranged in different orientations such that the orientation of the stack of sheets S changes as the stack of sheets S passes through the pairs of rollers.

The reversing eject rollers 74 are a pair of rollers that are positioned downstream of the reversing-and-transporting rollers 73 in the direction in which the stack of sheets S is transported. The reversing eject rollers 74 are configured to receive the stack of sheets S from the reversing-and-transporting rollers 73 and transport the stack of sheets S toward the second opening 72.

The second opening 72 is provided at the same side of the sheet processing apparatus 3 as the side at which the first opening 69 is provided, and is positioned below the first opening 69. The stack of sheets S subjected to the binding process may be transported through the second opening 72.

The second output tray 71, which is an example of a second transported-sheet-stack support unit, includes a surface on which multiple stacks of sheets S that have been ejected through the second opening 72 may be stacked. The surface of the second output tray 71 on which the stacks of sheets S are stacked is inclined. More specifically, the surface is inclined such that an end of the surface that is far from the second opening 72 is positioned below the other end that is adjacent to the second opening 72. Thus, the surface of the second output tray 71 is inclined in a direction different from the direction of inclination of the surface of the first output tray 70.

Stapler 40

The stapler 40, which is an example of a first binding unit, is configured to bind edge portions of the sheets S stacked on the compiling support unit 35 together by pushing staples 41 (described below) into the sheets S one by one. The stapler 40 is arranged adjacent to the compiling support unit 35 at the side at which the first side guide 38*a* is provided (lower side in FIG. 3).

In the present exemplary embodiment, the stapler 40 is provided at the side at which the first side guide 38*a* is provided and at the side at which the end guide 35*b* is provided. In other words, the stapler 40 is arranged at a corner between the side of the compiling support unit 35 at which the first side guide 38*a* is provided and the side of the compiling support unit 35 at which the end guide 35*b* is provided.

The stapler 40 is arranged at the side that faces the user (lower side in FIG. 3), so that processes for the stapler 40, such as refilling of the stapler 40 with the staples 41, may be easily performed.

A binding process performed by the stapler 40 will be described. A stapler motor (not shown) is driven so as to cause the stapler 40 to push a single staple 41 into the stack of sheets S. When the staple 41 is pushed into the stack of sheets S, the edge portions of the sheets S at the side where the first side guide 38*a* is provided are bound together.

Staple-Free Binding Device 50

Figure 4A:
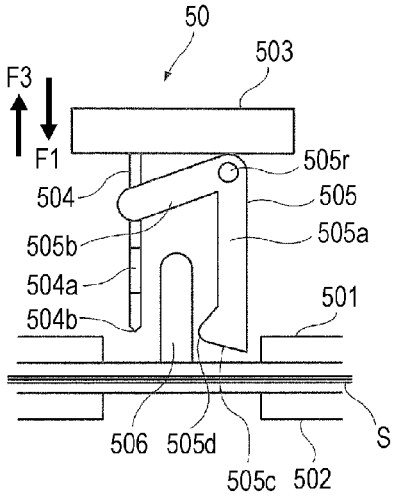
FIGS. 4A to 4D are diagrams illustrating the structure of a staple-free binding device and a staple-free binding process.
Figure 4B:
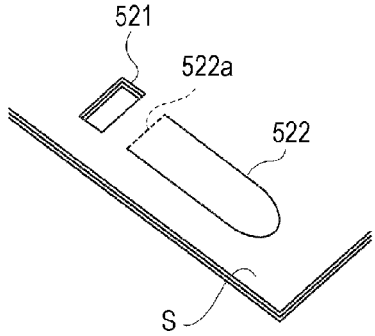
Figure 4C:
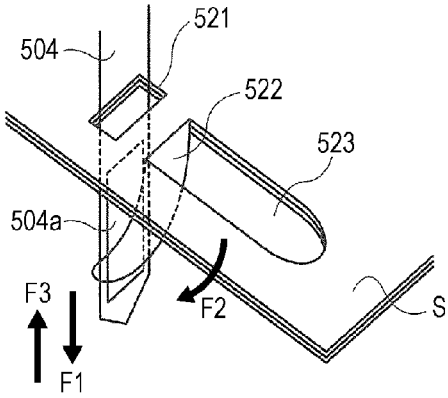
Figure 4D:
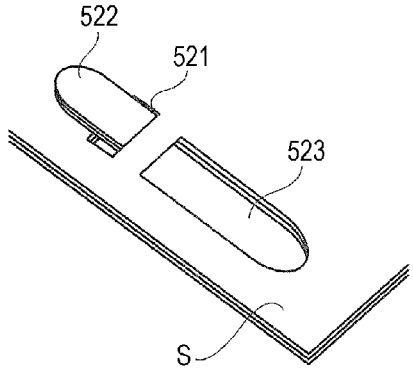

The structure of the staple-free binding device 50 will now be described with reference to FIGS. 3 and 4A to 4D. FIGS. 4A to 4D are diagrams illustrating the structure of the staple-free binding device 50 and a portion of a stack of sheets subjected to a staple-free binding process. FIG. 4A illustrates the structure of the staple-free binding device 50. FIG. 4B illustrates a slit 521 and a tongue portion 522 formed in a stack of sheets S. FIG. 4C illustrates the manner in which the tongue portion 522 is inserted into the slit 521. FIG. 4D illustrates a portion of the stack of sheets S that bound by the staple-free binding device 50.

The staple-free binding device 50, which is an example of a second binding unit, binds edge portions of the sheets S stacked on the compiling support unit 35 together without using the staples 41, as described in detail below. The staple-free binding device 50 is arranged adjacent to the compiling support unit 35 at the side at which the second side guide 38*b* is provided (upper side in FIG. 3). In the present exemplary embodiment, the stapler 40 is provided at the side of the compiling support unit 35 at which the first side guide 38*a* is provided and at the side of the compiling support unit 35 at which the end guide 35*b* is provided.

In the present exemplary embodiment, the stapler 40 is provided at the side that faces the user (lower side in FIG. 3) and at the side at which the end guide 35*b* is provided (left side in FIG. 3). In addition, the staple-free binding device 50 is provided at the side opposed to the stapler 40 (upper side in FIG. 3) and at the side at which the end guide 35*b* is provided (left side in FIG. 3). There are two reasons for this arrangement. That is, a reason related to work efficiency and a reason related to the size of the apparatus.

First, the reason related to work efficiency will be described. Comparing the stapler 40 and the staple-free binding device 50 with each other, it is clear that the stapler 40 is to be refilled with the staples 41 after a certain period of time, whereas it is not necessary to perform such a process for the staple-free binding device 50 since the staple-free binding device 50 does not use the staples 41. Thus, the frequency at which maintenance is to be performed for the stapler 40 is higher than the frequency at which maintenance is to be performed for the staple-free binding device 50. Therefore, processes for the stapler 40 may be facilitated compared to those for the staple-free binding device 50.

Next, the reason related to the size of the apparatus will be described. If the staple-free binding device 50 and the stapler 40 are arranged at the same side of the compiling support unit 35, it is difficult to place the staple-free binding device 50 and the stapler 40 near each other without causing an interference therebetween, owing to the sizes thereof.

For the above-described reasons, in the present exemplary embodiment, the stapler 40 and the staple-free binding device 50 are arranged in the above-described manner.

Next, the structure of the staple-free binding device 50 will be described in more detail with reference to FIGS. 4A to 4D.

The staple-free binding device 50 includes a base plate 501 and a base member 503 that are arranged so as to be opposed to each other. Referring to FIG. 4A, the staple-free binding device 50 binds the sheets S together by moving the base member 503 toward the base plate 501 (in a direction shown by arrow F1 in FIG. 4A) while the stack of sheets S is placed between the base plate 501 and a bottom member 502.

First, the base plate 501 will be described. The base plate 501 is provided with the bottom member 502 that is substantially parallel to the base plate 501 so that the sheets S are placeable between the base plate 501 and the bottom member 502. The base plate 501 is also provided with a projecting portion 506 that is formed integrally with the base plate 501. The projecting portion 506 projects toward the base member 503.

Next, the base member 503 will be described. The base member 503 includes a blade 504 that cuts into the stack of sheets S and a punching member 505 that forms the tongue portion 522 (described below) in the stack of sheets S and bends the tongue portion 522 so as to insert the tongue portion 522 into a cut portion formed by the blade 504.

The blade 504, which is an example of a cutting portion, is formed of a substantially rectangular plate-shaped member that advances or retreats toward the stack of sheets S placed between the base plate 501 and the bottom member 502. More specifically, the blade 504 has an eyelet 504*a* formed in a substantially rectangular surface thereof, and includes an end portion 504*b* having a width that decreases toward the sheets S.

The punching member 505, which is an example of a tongue-portion forming member and a tongue-portion inserting member, includes an L-shaped bent portion. A portion of the punching member 505 at one end thereof serves as a first part 505*a*, and a portion of the punching member 505 at the other end thereof serves as a second part 505*b*.

The punching member 505 also includes a first-part rotation shaft 505*r* provided at the L-shaped bent portion. The punching member 505 is rotatable around the first-part rotation shaft 505*r*. More specifically, the first part 505*a* is capable of tilting toward the blade 504. A gap is provided between the second part 505*b* and the base member 503 to allow the rotation of the punching member 505.

The first part 505*a* extends toward the base plate 501. The first part 505*a* is provided with a cutting-edge portion 505*c* at an end opposite to the end at which the first-part rotation shaft 505*r* is provided, that is, at the end near the base plate 501. The cutting-edge portion 505*c* includes a cutting edge for cutting the stack of sheets S for forming the shape of the tongue portion 522. The cutting-edge portion 505*c* has no cutting edge at a side that faces the blade 504, so that the tongue portion 522 is connected to the sheets S at an end portion 522*a* thereof, which will be described below. The first part 505*a* is also provided with a projection 505*d* that projects toward the blade 504 at a side of the first part 505*a*, more specifically, at a side that faces the blade 504.

The binding process performed by the staple-free binding device 50 will be described.

First, a staple-free-binding motor (not shown) is driven so as to move the base member 503 toward the base plate 501. Accordingly, the end portion 504*b* of the blade 504 and the cutting-edge portion 505*c* of the punching member 505 pierce through the stack of sheets S. As a result, the slit 521 and the tongue portion 522 are formed in the stack of sheets S, as illustrated in FIG. 4B. The tongue portion 522 is formed by cutting the stack of sheets S such that the end portion 522*a* of the tongue portion 522 is left uncut.

Then, when the base member 503 is further pushed downward, the second part 505*b* of the punching member 505 comes into contact with the projecting portion 506 that is formed integrally with the base plate 501, so that the punching member 505 rotates clockwise in FIG. 4A around the first-part rotation shaft 505*r*. Accordingly, the first part 505*a* tilts toward the blade 504 and the projection 505*d* on the punching member 505 approaches the blade 504. Then, as illustrated in FIG. 4C, the tongue portion 522 is bent and is pushed into the eyelet 504*a* in the blade 504 in a direction shown by arrow F2 in FIG. 4C by the projection 505*d* provided on the punching member 505. In FIG. 4C, the punching member 505 is not illustrated.

After that, the base member 503 is moved away from the base plate 501. When the base member 503 is moved upward in a direction shown by arrow F3 in FIG. 4C, the blade 504 moves upward while the tongue portion 522 is caught in the eyelet 504*a* in the blade 504. Therefore, as illustrated in FIG. 4D, the tongue portion 522 is inserted into the slit 521, thereby binding the sheets S together. In this state, a binding hole 523 is formed in the stack of sheets S at a position where the tongue portion 522 is cut.

Figure 5A:
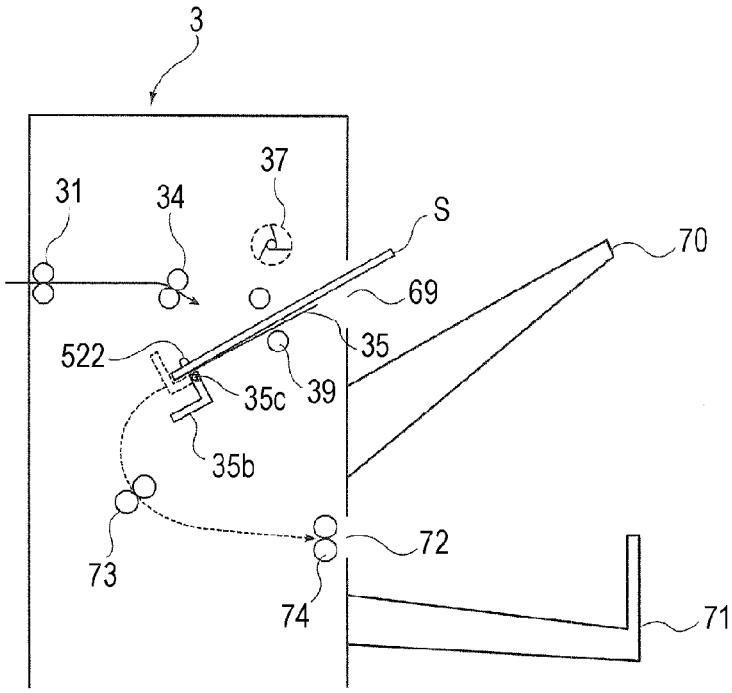
FIGS. 5A and 5B are diagrams illustrating a movement of a stack of sheets bound together by the staple-free binding device.
Figure 5B:
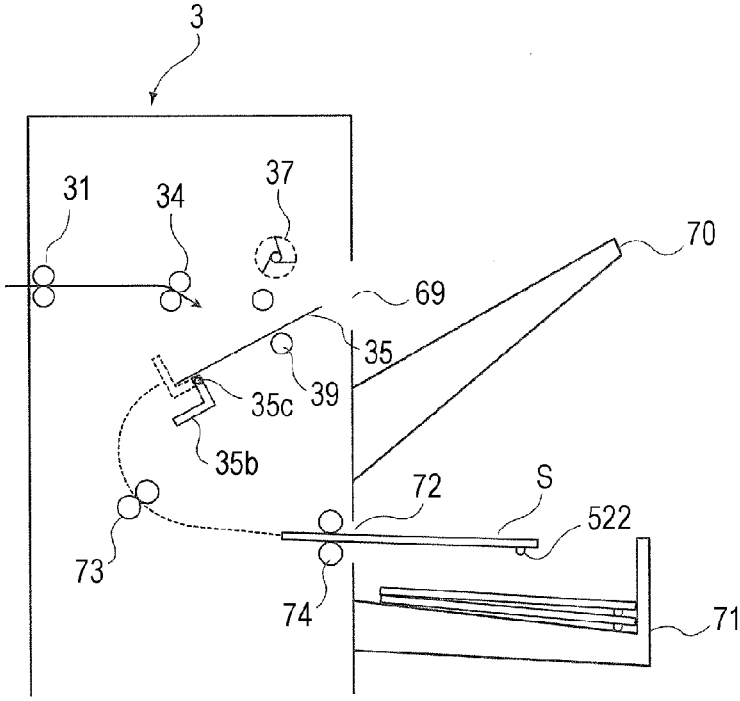

Next, an example of the operation of the image forming system 1 will be described with reference to FIGS. 1 to 5B. FIGS. 5A and 5B are diagrams illustrating a movement of a stack of sheets S bound together by the staple-free binding device 50. More specifically, FIG. 5A illustrates a movement of the stack of sheets S transported from the compiling support unit 35, and FIG. 5B illustrates a movement of the stack of sheets S ejected onto the second output tray 71.

The image forming system 1 described herein binds each stack of sheets S using only one of the stapler 40 and the staple-free binding device 50.

In the state before the toner image is formed on a first sheet S by the image forming unit 5 in the image forming apparatus 2, components are arranged in the following manner. That is, the first eject roller 39*a* is arranged at position P1 and the paddle unit 37 is arranged at position Pa. In addition, the first side guide 38*a* is arranged at position Pay and the second side guide 38*b* is arranged at position Pbx.

First, the toner image is formed on the first sheet S by the image forming unit 5 in the image forming apparatus 2. As illustrated in FIG. 1, the first sheet S on which the toner image is formed is reversed as necessary by the paper-sheet reversing device 7, and is supplied to the paper-sheet processing apparatus 3 through the eject rollers 9.

In the transporting device 10 of the paper-sheet processing apparatus 3 to which the first sheet S is supplied, the first sheet S is received by the inlet rollers 11 and is subjected to a punching process as necessary by the puncher 12. Then, the first sheet S is transported toward the post-processing device 30 at the downstream side by the first transporting rollers 13 and the second transporting rollers 14.

The first sheet S is received by the receiving rollers 31 in the post-processing device 30. The first sheet S passes through the receiving rollers 31 and is transported in the first moving direction S1 by the exit rollers 34. At this time, the first sheet S is transported through a space between the compiling support unit 35 and the first eject roller 39*a* and a space between the compiling support unit 35 and the paddle unit 37.

After the front end of the first sheet S in the first moving direction S1 passes through the space between the compiling support unit 35 and the paddle unit 37, the paddle unit 37 moves downward (in the direction shown by arrow U1 in FIG. 2) from position Pa to position Pb. Accordingly, the paddle unit 37 comes into contact with the first sheet S. Then, the first sheet S is pushed in the second moving direction S2 in FIG. 2 when the paddle unit 37 is rotated in the direction shown by arrow R in FIG. 2, so that an edge portion of the first sheet S that faces the end guide 35*b* comes into contact with the end guide 35*b*. Then, the paddle unit 37 moves upward (in the direction shown by arrow U2 in FIG. 2) away from the first sheet S, and is arranged at position Pa again.

Thus, the first sheet S is received by the compiling support unit 35. After the edge portion of the first sheet S that faces the end guide 35*b* reaches the end guide 35*b*, the first side guide 38*a* moves toward the compiling support unit 35 (in the direction shown by arrow C2 in FIG. 3) from position Pay to position Pax. At this time, the second side guide 38*b* remains at position Pbx. Therefore, the first side guide 38*a* pushes the first sheet S such that the first sheet S comes into contact with the second side guide 38*b*. Then, the first side guide 38*a* moves in a direction away from the compiling support unit 35 (in the direction shown by arrow C1 in FIG. 3), so that the first side guide 38*a* is moved away from the first sheet S and is arranged at position Pay again.

Also when the second and the following sheets S, on each of which the toner image is formed by the image forming unit 5, are successively supplied to the post-processing device 30 after the first sheet S, the edge portions of the sheets S are aligned by the paddle unit 37 and the side guide unit 38 by an operation similar to the above-described operation. More specifically, the second sheet S is supplied in the state in which the first sheet S is aligned, and the second sheet S is aligned with respect to the first sheet S. A similar process is performed when the third and the following sheets S are supplied. Thus, a preset number of sheets S are placed on the compiling support unit 35 as a stack of sheets S in which the edge portions of the sheets S are aligned.

Then, the first eject roller 39*a* moves downward (in the direction shown by arrow Q1 in FIG. 2) from position P1 to position P2. Accordingly, the stack of sheets S being maintained in the aligned state by nipped between the first eject roller 39*a* and the second eject roller 39*b*.

Next, the edge portions of the sheets S stacked on the compiling support unit 35 are bound together by one of the stapler 40 and the staple-free binding device 50.

The stack of sheets S bound together by one of the stapler 40 and the staple-free binding device 50 is ejected from the compiling support unit 35 when the first eject roller 39*a* rotates in a forward direction (shown by arrow T1 in FIG. 2) or a reverse direction (shown by arrow T2 in FIG. 2).

An ejection transporting path along which the stack of sheets S is ejected from the compiling support unit 35 may be a first ejection transporting path or the second ejection transporting path. When the stack of sheets S is transported along the first ejection transporting path, the stack of sheets S is ejected onto the first output tray 70 through the first opening 69. When the stack of sheets S is transported along the second ejection transporting path, the stack of sheets S is transported through the reversing-and-transporting rollers 73 and ejected onto the second output tray 71 through the second opening 72. Thus, the direction in which the stack of sheets S is ejected from the compiling support unit 35 to be transported along the first ejection transporting path is opposite to the direction in which the stack of sheets S is ejected from the compiling support unit 35 to be transported along the second ejection transporting path.

The stack of sheets S is transported along the first ejection transporting path if the stack of sheets S is processed by the stapler 40, and is transported along the second ejection transporting path if the stack of sheets S is processed by the staple-free binding device 50.

The operation of ejecting the stack of sheets S from the compiling support unit 35 will be further described. First, the operation of ejecting the stack of sheets S along the first ejection transporting path will be described. Then, the operation of ejecting the stack of sheets S along the second ejection transporting path will be described.

In the case where the stack of sheets S is ejected along the first ejection transporting path, the first eject roller 39*a* rotates in the direction shown by arrow T1 in FIG. 2 to eject the stack of sheets S from the compiling support unit 35 (in the third moving direction S3 in FIG. 2). Then, the stack of sheets S is ejected onto the first output tray 70 through the first opening 69.

In the case where the stack of sheets S is ejected along the second ejection transporting path, the end guide 35*b* rotates around the rotation shaft 35*c*. Accordingly, the end guide 35*b* moves to a position at which the end guide 35*b* does not interfere with the movement of the stack of sheets S in a direction toward the second ejection transporting path (in the second moving direction S2 in FIG. 2).

Then, the first eject roller 39*a* rotates in the direction shown by arrow T2 in FIG. 2 to eject the stack of sheets S from the compiling support unit 35 (in the second moving direction S2 in FIG. 2).

The ejected stack of sheets S is transported while being reversed upside down by the reversing-and-transporting rollers 73. Then, the stack of sheets S is ejected onto the second output tray 71 through the second opening 72.

As described above, stacks of sheets S bound together by the stapler 40 and stacks of sheets S bound together by the staple-free binding device 50 are respectively transported along the first ejection transporting path and the second ejection transporting path that differ from each other. Therefore, the risk that the bound portions of the stacks of sheets S bound together by the staple-free binding device 50 will be damaged may be reduced. This will be described in more detail.

Each of the bound portions of the stacks of sheets S bound together by the staple-free binding device 50 includes a portion that projects from a surface of the stack of sheets S in a thickness direction thereof. For example, a tip end the tongue portion 522 projects from a surface of the stack of sheets S (see FIG. 4D). In addition, although not illustrated in FIG. 4D, a bent portion of the tongue portion 522 projects from a back surface of the stack of sheets S.

In the case where there are portions that project from the surfaces of the stacks of sheets S, the portions that project from the surfaces of the stacks of sheets S are easily damaged when the binding process is performed successively.

Damages of the projecting portions will be described. As an example, a stack of sheets S ejected onto the first output tray 70 through the first opening 69 is assumed as a first stack of sheets S (hereinafter referred to as a first sheet stack), and a stack of sheets S ejected onto the first output tray 70 immediately after the first sheet stack (hereinafter referred to as a next sheet stack) will be considered.

In the case where the first sheet stack and the next sheet stack are individually transported and are stacked on the same output tray, the next sheet stack is transported so as to slide along a surface of the first sheet stack while being in contact therewith. In this case, if there are projecting portions on the surfaces of the first sheet stack and the next sheet stack that face each other, the projecting portions are easily damaged when the next sheet stack is transported while being in contact with the first sheet stack. For example, a projecting portion that projects on the upper surface of the first sheet stack may be damaged when the projecting portion is interfered with or is caught by an edge portion of the next sheet stack at a front end of the next sheet stack in the transporting direction thereof.

The staple-free binding device 50 binds the sheets S together by processing parts of the sheets S. Therefore, the staple-free binding device 50 is used to bind, for example, about two to ten sheets S together. The stapler 40 binds the sheets S together by using metal staples. Therefore, the stapler 40 is capable of binding, for example, about 100 sheets S. As a result, the weight of the stack of sheets S bound together by the stapler 40 may be considerably larger than the weight of the stack of sheets S bound together by the staple-free binding device 50. Therefore, if, in particular, the first sheet stack is bound by the staple-free binding device 50 and the next sheet stack is bound by the stapler 40, the projecting portion on the previous sheet stack is very easily damaged, owing to the weight of the next sheet stack.

In order to reduce the risk of the damages described above, the stack of sheets S bound together by the staple-free binding device 50, may be pass through an area different from an area through which the stack of sheets S bound together by the stapler 40 passes.

As described above, stacks of sheets S bound together by the stapler 40 and stacks of sheets S bound together by the staple-free binding device 50 may be transported along the different paths. In such a case, the bound portions of the stacks of sheets S bound together by the staple-free binding device 50 pass through an area different from an area through which the stacks of sheets S bound together by the stapler 40 pass. Therefore, the risk of the damages that the bound portions of the stacks of sheets S bound together by the staple-free binding device 50 may be reduced.

As described above, the projecting portion that projects on the upper surface of the first sheet stack may be damaged when the projecting portion is interfered with or is caught by the edge portion of the next sheet stack at the front end thereof in the transporting direction. Therefore, the stacks of sheets S may be stacked on the second output tray 71 such that the projecting portions that project from the surfaces of the stacks of sheets S face downward. In such a case, the risk that the projecting portion on the first sheet stack will be damaged by the edge portion of the next sheet stack at the front end thereof in the transporting direction is reduced.

Other Exemplary Embodiments

Next, the operation of another exemplary embodiment will be described with reference to FIGS. 6A to 8. In this exemplary embodiment, stacks of sheets S are ejected such that the bound portions thereof are displaced from each other.

Figure 6A:
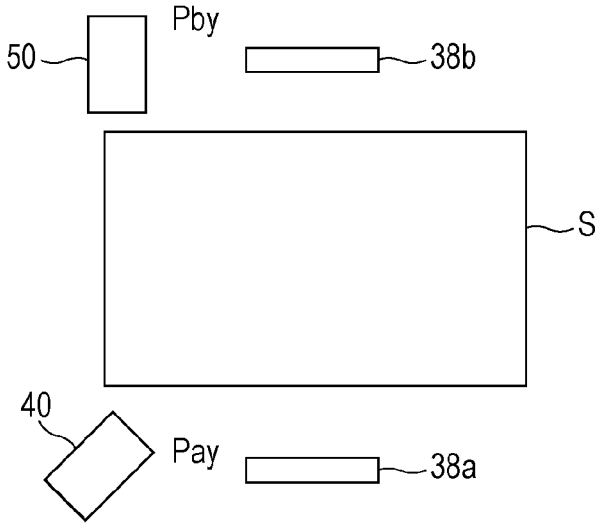
FIGS. 6A and 6B are diagrams illustrating a movement of a sheet to be subjected to a binding process performed by the staple-free binding device according to another exemplary embodiment.
Figure 6B:
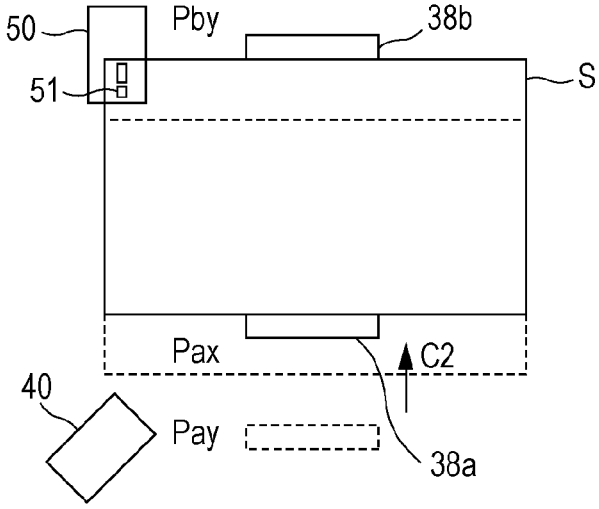

FIGS. 6A and 6B are diagrams illustrating a movement of a sheet S to be subjected to the binding process performed by the staple-free binding device 50. FIGS. 6A and 6B illustrate the area around the compiling support unit 35 viewed in a direction shown by arrow III in FIG. 2. In FIGS. 6A and 6B, the compiling support unit 35 is not illustrated. FIG. 6A illustrates the positional relationship between the sheet S to be subjected to the binding process performed by the staple-free binding device 50 and the tamper unit 38. FIG. 6B illustrates the position of the sheet S after the binding process performed by the staple-free binding device 50.

Figure 7A:
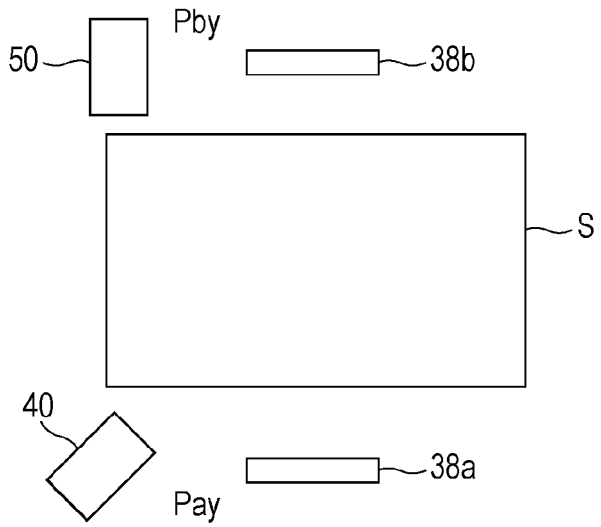
FIGS. 7A and 7B are diagrams illustrating a movement of a sheet to be subjected to a binding process performed by a stapler according to the another exemplary embodiment.
Figure 7B:
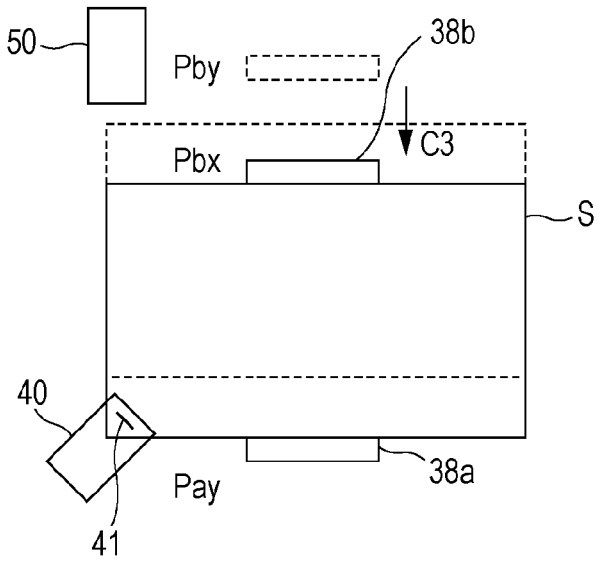

FIGS. 7A and 7B are diagrams illustrating a movement of a sheet S to be subjected to the binding process performed by the stapler 40. FIG. 7A illustrates the positional relationship between the sheet S to be subjected to the binding process performed by the stapler 40 and the tamper unit 38. FIG. 7B illustrates the position of the sheet S after the binding process performed by the stapler 40.

Figure 8:
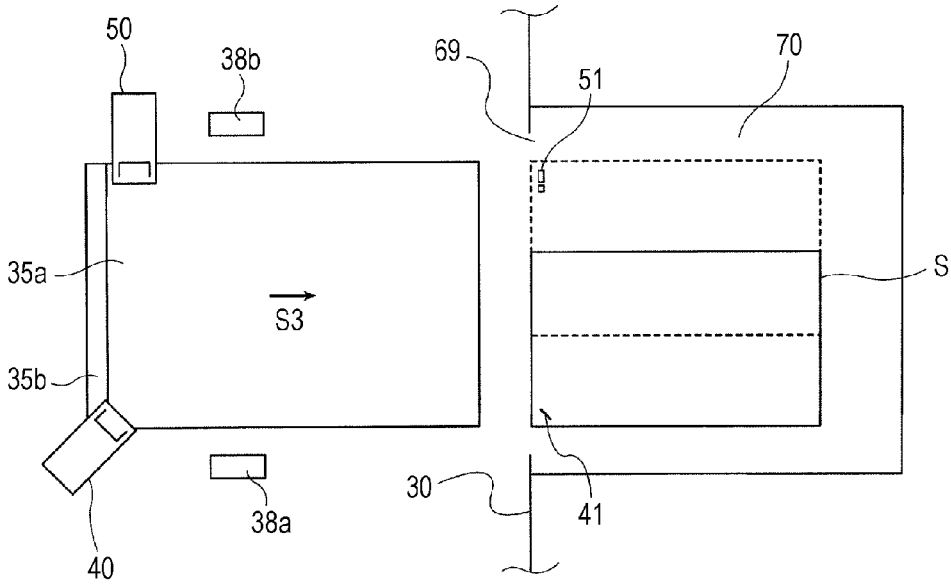
FIG. 8 is a diagram illustrating positions of stacks of sheets subjected to the binding processes according to the another exemplary embodiment.

FIG. 8 is a diagram illustrating the positions of the stacks of sheets S subjected to the binding processes performed by the stapler 40 and the staple-free binding device 50 and ejected to the first stacker 70 through the first opening 69.

The difference between the exemplary embodiment illustrated in FIG. 3 and the exemplary embodiment illustrated in FIGS. 6A to 8 will now be described.

In the exemplary embodiment illustrated in FIG. 3, the stack of sheets S to be subjected to the binding process is placed at a constant position irrespective of whether the stack of sheets S is to be subjected to the binding process performed by the staple-free binding device 50 or to the binding process performed by the stapler 40. In other words, the stack of sheets S is subjected to the binding process at a constant position on the bottom portion 35*a* of the compiling support unit 35.

In the exemplary embodiment illustrated in FIGS. 6A to 8, the stack of sheets S is placed at different positions on the bottom portion 35*a* of the compiling support unit 35 depending on whether the stack of sheets S is to be subjected to the binding process performed by the staple-free binding device 50 or to the binding process performed by the stapler 40. Specifically, the stack of sheets S is placed at different positions in a direction that crosses the ejection transporting path (vertical direction in FIG. 8). More specifically, the stack of sheets S bound together by the staple-free binding device 50 is disposed at a position higher (closer to the second tamper 38*b*) than the stack of sheets S bound together by the stapler 40 in FIG. 8.

To allow the binding process to be performed at predetermined positions, the distance between the stapler 40 and the staple-free binding device 50 in the structure illustrated in FIGS. 6A to 8 is larger than the distance between the stapler 40 and the staple-free binding device 50 in the structure illustrated in FIG. 3. In the structure illustrated in FIGS. 6A to 8, the stapler 40 and the staple-free binding device 50 are arranged such that the distance therebetween is larger than the dimension of the sheets S to be bound together (dimension in the vertical direction in FIG. 8).

In the above-described exemplary embodiment, the stacks of sheets S bound together by the stapler 40 are transported along the first ejection transporting path, and the stacks of sheets S bound together by the staple-free binding device 50 are transported along the second ejection transporting path.

However, in the exemplary embodiment illustrated in FIGS. 6A and 6B, the stacks of sheets S bound together by the stapler 40 and the stacks of sheets S bound together the staple-free binding device 50 are transported along the same ejection transporting path. In this example, the stacks of sheets S are transported along the first ejection transporting path.

The structure in which the stacks of sheets S are disposed at different positions will now be described in more detail with reference to FIGS. 6A to 8.

First, the arrangement of the tamper unit 38 and the sheets S subjected to the binding process performed by the staple-free binding device 50 will be described with reference to FIGS. 6A and 6B. As illustrated in FIG. 6A, when a sheet S is supplied to the compiling support unit 35, the first tamper 38*a* and the second tamper 38*b* are disposed at positions separated from the bottom portion 35*a* of the compiling support unit 35 (see FIG. 3). More specifically, the first tamper 38*a* and the second tamper 38*b* are disposed at positions Pay and Pby, respectively. The sheet S is supplied to a position between the first tamper 38*a* and the second tamper 38*b* that are separated from the bottom portion 35*a* of the compiling support unit 35.

Then, as illustrated in FIG. 6B, while the sheet S is positioned between the first tamper 38*a* and the second tamper 38*b* (see the sheet S drawn by dashed lines in FIG. 6B), the first tamper 38*a* moves toward the second tamper 38*b* (in the direction shown by arrow C2 in FIG. 6B). More specifically, the first tamper 38*a* moves from position Pay to position Pax. As the first tamper 38*a* moves, the sheet S moves toward the second tamper 38*b* and comes into contact with the second tamper 38*b* disposed at position Pby (see the sheet S drawn by solid lines in FIG. 6B).

Also when the second and the following sheets S are successively supplied to the post-processing device 30, edge portions of the sheets S are aligned by the tamper unit 38 such that the sheets S are in contact with the second tamper 38*b* disposed at position Pby by an operation similar to the above-described operation.

The sheets S are subjected to the binding process performed by the staple-free binding device 50 at a position where the sheets S are in contact with the second tamper 38*b*. In the present exemplary embodiment, a staple-free binding portion 51, which is a portion of the stack of sheets S that has been subjected to the binding process performed by the staple-free binding device 50, is at an upper edge of the stack of sheets S (edge near the second tamper 38*b*) in FIG. 6B. The stack of sheets S subjected to the binding process is ejected by the eject rollers 39 toward the first ejection transporting path (toward the right side in FIGS. 6A and 6B), and is placed on the first stacker 70.

Next, the arrangement of the tamper unit 38 and the sheets S subjected to the binding process performed by the stapler 40 will be described with reference to FIGS. 7A and 7B. As illustrated in FIG. 7A, when a sheet S is supplied to the compiling support unit 35, a state similar to that illustrated in FIG. 6A is established. More specifically, the first tamper 38*a* and the second tamper 38*b* are disposed at positions Pay and Pby, respectively, which are positions separated from the bottom portion 35*a* of the compiling support unit 35 (see FIG. 3). The sheet S is supplied to a position between the first tamper 38*a* and the second tamper 38*b* that are separated from the bottom portion 35*a* of the compiling support unit 35 (see FIG. 3).

The operation illustrated in FIG. 7B differs from the operation illustrated in FIG. 6B. As illustrated in FIG. 7B, while the sheet S is positioned between the first tamper 38*a* and the second tamper 38*b* (see the sheet S shown by dashed lines in FIG. 7B), the second tamper 38*b* moves toward the first tamper 38*a* (in the direction shown by arrow C3 in FIG. 7B). More specifically, the second tamper 38*b* moves from position Pby to position Pbx. As the second tamper 38*b* moves, the sheet S moves toward the first tamper 38*a* and comes into contact with the first tamper 38*a* disposed at position Pay (see the sheet S drawn by solid lines in FIG. 7B).

Also when the second and the following sheets S are successively supplied to the post-processing device 30, the edge portions of the sheets S are aligned by the tamper unit 38 such that the sheets S are in contact with the first tamper 38*a* disposed at position Pay by an operation similar to the above-described operation.

The sheets S are subjected to the binding process performed by the stapler 40 at a position where the sheets S are in contact with the first tamper 38*a*. In the present exemplary embodiment, a staple 41, which defines a portion of the stack of sheets S that has been subjected to the binding process performed by the stapler 40, is at a lower edge of the stack of sheets S (edge near the first tamper 38*a*) in FIG. 7B. The stack of sheets S subjected to the binding process is ejected by the eject rollers 39 toward the first ejection transporting path (toward the right side in FIGS. 7A and 7B), and is placed on the first stacker 70.

As described above, in the present exemplary embodiment, the stack of sheets S subjected to the binding process performed by the staple-free binding device 50 and the stack of sheets S subjected to the binding process performed by the stapler 40 are placed at different positions on the bottom portion 35*a* of the compiling support unit 35. More specifically, the stacks of sheets S are disposed at different positions in a direction that crosses the direction in which the stacks of sheets S are transported (direction shown by arrow S3 in FIG. 8).

The staple 41 and the staple-free binding portion 51 are continuously located at different positions in the direction that crosses the transporting direction of the stacks of sheets while the stacks of sheets S are being transported. Therefore, the area through which the staple 41 passes and the area through which the staple-free binding portion 51 passes do not overlap.

As illustrated in FIG. 8, also in the state in which the stacks of sheets S are placed on the first stacker 70, the position of the staple 41 which binds a stack of sheets S and the position of the staple-free binding portion 51 which binds another stack of sheets S do not overlap.

Therefore, the risk that the staple-free binding portion 51, which is the bound portion of the stack of sheets S bound together by the staple-free binding device 50, will be damaged during transportation may be reduced.

Although a case in which the tamper unit 38 is operated each time a sheet S is supplied and then the binding process is performed at either of the predetermined positions is described above, the operation is not limited to this. For example, a stack of sheets S may be formed without moving the sheets S from the position where the sheets S are supplied to the compiling support unit 35. Then, the stack of sheets S may be processed by the staple-free binding device 50 or the stapler 40 at the position where the sheets S are supplied, and subsequently be moved to the corresponding predetermined position. More specifically, instead of moving the sheets S one at a time, the stack of sheets S may be moved to one of the positions that differ from each other in the direction that crosses the direction in which the stack of sheets S is transported (direction shown by arrow S3 in FIG. 2) after being subjected to the binding process.

In the above-described example, the tamper unit 38 that aligns the sheets S is used to place the stack of sheets S bound together by the staple-free binding device 50 and the stack of sheets S bound together by the stapler 40 at different positions. However, the structure for placing the stacks of sheets S at different positions is not limited to this. For example, the stacks of sheets S may be moved by a member different from the tamper unit 38.

In addition, although the stacks of sheets S are moved to different positions on the compiling support unit 35 in the above-described example, the stacks of sheets S may instead be moved at another location. For example, the stacks of sheets S may be moved by an arranging mechanism when the stacks of sheets S are ejected to the first stacker 70 through the first opening 69. The arranging mechanism is provided at, for example, the first opening 69. When each stack of sheets S passes through the first opening 69, the arranging mechanism moves the stack of sheets S in the direction that crosses the direction in which the stack of sheets S is transported (direction shown by arrow S3 in FIG. 8) in accordance with whether the sheets S have been bound together by the staple-free binding device 50 or the stapler 40.

In the above-described exemplary embodiments, the staple-free binding device 50 binds the sheets S by forming the tongue portion 522 and the slit 521. However, the structure of the staple-free binding device 50 is not limited to this.

Figure 9A:
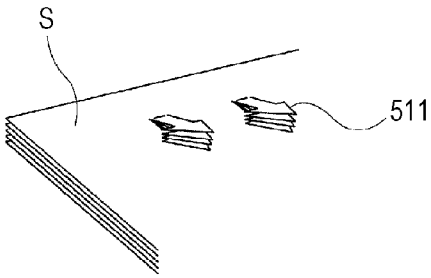
FIGS. 9A and 9B are diagrams illustrating stacks of sheets bound by staple-free binding device according to other exemplary embodiments.
Figure 9B:
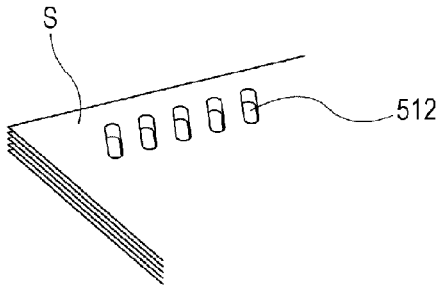

Other structures of the staple-free binding device 50 will now be described with reference to FIGS. 9A and 9B. FIGS. 9A and 9B are diagrams illustrating stacks of sheets subjected to staple-free binding processes according to other exemplary embodiments. FIG. 9A illustrates a binding process performed by forming arrow-shaped portions, and FIG. 9*b* illustrates a binding process performed by forming embossed portions.

In the binding process illustrated in FIG. 9A, arrow-shaped portions 511 are formed at a part of the stack of sheets S. The arrow-shaped portions 511 are formed so as to remain attached to the sheets S at ends opposite to the pointed ends thereof. The arrow-shaped portions 511 are raised so that the sheets S are retained together by the frictional force between the arrow-shaped portions 511 and holes formed when the arrow-shaped portions 511 are cut.

In the binding process illustrated in FIG. 9B, the sheets S are bound together by forming embossed marks 512 at a part of the stack of sheets S. More specifically, a member for forming the embossed marks 512 is pressed against the stack of sheets S in a direction from a surface at the upper side in FIG. 9B toward a surface at the opposite side. Accordingly, recesses are formed in the surface of the stack of sheets S at the side viewable in FIG. 9B (projections are formed on a surface at the opposite side), so that the sheets S are bound together.

In either of the exemplary embodiments illustrated in FIGS. 9A and 9B, the stack of sheets S has a portion that projects from the surface of the stack of sheets S at least at one side thereof. Therefore, similar to the above-described exemplary embodiments, when stacks of sheets S are successively subjected to the binding process, the portions that project from the surfaces of the stacks of sheets S are easily damaged.

Although the positions of the stapler 40 and the staple-free binding device 50 are not moved in the above-described exemplary embodiments, the positions of the stapler 40 and the staple-free binding device 50 are not limited to this. For example, the stapler 40 and the staple-free binding device 50 may be movable along rails provided at the periphery of the compiling support unit 35. In the case where the stapler 40 and the staple-free binding device 50 are movable, the position at which the sheets S are bound together may be changed. In addition, the position at which the binding process is performed may be changed in accordance with the size or orientation of the sheets S.

As described above, the image forming system 1 binds each stack of sheets S using only one of the stapler 40 and the staple-free binding device 50. Whether to use the stapler 40 or the staple-free binding device 50 may be arbitrarily selected.

The controller 80 may determine whether to use the stapler 40 or the staple-free binding device 50 on the basis of the number of sheets S included in the stack of sheets S, the kind of the sheets S (cardboard paper, thin paper, coated paper, etc.), and the thickness of the stack of sheets S. For example, the staple-free binding device 50 may be used to bind the sheets S when the number of sheets S is smaller than or equal to a predetermined number, and the stapler 40 may be used to bind the sheets S when the number of sheets S is larger than the predetermined number.

Even when the controller 80 is instructed to bind the sheets S using one of the binding units, if it is not appropriate to bind the sheets S using the binding unit selected by the instruction, the controller 80 may switch the binding unit to be used to the other binding unit. Alternatively, the controller 80 may display a message that the instruction is not appropriate through the user interface 90. For example, the controller 80 may determine whether or not it is appropriate to bind the sheets S together using the binding unit selected by the instruction on the basis of the kind of the sheets S (cardboard paper, thin paper, coated paper, etc.) and the thickness of the stack of sheets S.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet processing apparatus comprising:

a support unit on which sheets are placed;

a first binding unit that performs a first binding process to bind a first plurality of the sheets, placed on the support unit, at a first binding portion to form a first sheet stack;

a second binding unit that performs a second binding process, different from the first binding process, to bind a second plurality of the sheets, placed on the support unit, at a second binding portion to form a second sheet stack;

a transporting unit that transports the first sheet stack from the support unit to a first output area via a first path and transports the second sheet stack from the support unit to a second output area via a second path different from the first path; and a controller which controls the first binding unit to perform the first binding process, the second binding unit to perform the second binding process, and the transporting unit to transport the first sheet stack to the first output area and the second sheet stack to the second output area, wherein the first binding unit and the second binding unit are arranged to bind edge portions of the first and second plurality of the sheets, respectively.

2. A sheet processing method comprising:

performing a first binding process to bind a first plurality of sheets, placed on a support unit, at a first binding portion to form a first sheet stack;

performing a second binding process, different from the first binding process, to bind a second plurality of sheets, placed on the support unit, at a second binding portion to form a second sheet stack; and transporting the first sheet stack from the support unit to a first output area via a first path and the second sheet stack from the support unit to a second output area via a second path different from the first path, wherein the first and second binding processes comprise binding edge portions of the first and second plurality of the sheets, respectively.

3. The sheet processing method of claim 2, wherein the first sheet stack and the second sheet stack are placed in the first output area and the second output area, respectively, such that the first binding portion of the first sheet stack does not overlap the second binding portion of the second sheet stack.

4. A sheet processing apparatus comprising:

a first binding unit that performs a first binding process to bind a first plurality of sheets to form a first sheet stack;

a second binding unit that performs a second binding process, different from the first binding process, to bind a second plurality of sheets to form a second sheet stack;

a transporting unit that transports the first sheet stack formed by the first binding unit to a first output area via a first path and transports the second sheet stack formed by the second binding unit to a second output area via a second path different from the first path; and a controller which controls the first binding unit to perform the first binding process and the second binding unit to perform the second binding process, wherein the first binding unit and the second binding unit are arranged to bind edge portions of the first and second plurality of the sheets, respectively.

5. The sheet processing apparatus according to claim 4, further comprising:

a support unit on which a plurality of sheets are placed, the plurality of sheets comprising the first plurality of sheets and the second plurality of sheets;

an edge aligner that aligns an edge portion of the plurality of the sheets placed on the support unit.

6. The sheet processing apparatus according to claim 4, wherein the second binding unit performs the second binding process by deforming the second plurality of the sheets at the second binding portion, deformed parts of the second plurality of the sheets being engaged with each other at a second binding portion to form the second sheet stack.

7. The sheet processing apparatus according to claim 6, wherein the second binding portion of the second sheet stack has a projecting portion, the projecting portion projecting downward when the second sheet stack is placed on the second output area.

8. The sheet processing apparatus according to claim 4, wherein the second binding unit includes a cutting member that forms a cut portion in the second plurality of the sheets at a second binding portion, a tongue-portion forming and inserting member that (i) forms a tongue portion in the second plurality of the sheets by partially cutting the second plurality of the sheets at the second binding portion into a predetermined shape, the tongue portion remaining attached to the second plurality of the sheets at one end, and (ii) inserts a free-end of the tongue portion into the cut portion.

9. The sheet processing apparatus according to claim 8, wherein the free-end of the tongue portion that is inserted into the cut portion projects downward when the second sheet stack is placed on the second output area.

10. The sheet processing apparatus according to claim 4, wherein the first binding unit binds the first plurality of the sheets at a first binding portion using a staple.

11. An image forming system, comprising:

the sheet processing apparatus according to claim 4; and an image forming apparatus that forms images on the sheets and supplies the sheets to the sheet processing apparatus.

12. The sheet processing apparatus of claim 4, wherein the first sheet stack and the second sheet stack are placed in the first output area and the second output area, respectively, such that a first binding portion of the first sheet stack does not overlap a second binding portion of the second sheet stack.

* * * * *